US005779873A

United States Patent [19]

Law et al.

[11] Patent Number: 5,779,873

[45] Date of Patent: Jul. 14, 1998

[54] ELECTROPLATING OF NICKEL ON NICKEL FERRITE DEVICES

[75] Inventors: Henry Hon Law, Berkeley Heights; Lynn Frances Schneemeyer, Westfield; Te-Sung Wu, New Providence, all of N.J.

[73] Assignee: Lucent Technologies Inc., Murray Hill, N.J.

[21] Appl. No.: 769,189

[22] Filed: Dec. 18, 1996

Related U.S. Application Data

[63] Continuation-in-part of Ser. No. 581,079, Dec. 29, 1995, abandoned.

[51] Int. Cl.[6] ..... C25D 3/12; C25D 5/10; C25C 28/02

[52] U.S. Cl. ..... 205/271; 205/273; 205/274; 205/280; 205/257; 205/176; 205/182; 205/184; 205/186; 205/187

[58] Field of Search ..... 205/176, 182, 205/184, 186, 187, 257, 271, 273, 274, 280

[56] References Cited

U.S. PATENT DOCUMENTS

| | | | |
|---|---|---|---|
| 4,270,986 | 6/1981 | Smith | 204/48 |
| 4,375,390 | 3/1983 | Anderson | 204/15 |

FOREIGN PATENT DOCUMENTS

| | | | |
|---|---|---|---|
| 3-159207 | 7/1991 | Japan . | |
| 2 119 401 A | 11/1983 | United Kingdom | C23F 13/00 |
| 2119401 | 11/1983 | United Kingdom . | |

OTHER PUBLICATIONS

"Borate Buffer Equilibria in Nickel Refining Electrolytes", by Tilak, B. V. et al., *Journal of Applied Electrochemistry*, 7, pp. 495–500 (1977). No month available.

"Nickel Solution Buffers and Limiting Current Density," by DuRose, A. H., *Plating and Surface Finishing*, pp. 48–52 (Aug. 1977).

"The Buffering Action of Nickel Acetate in Nickel Plating Solutions", by Gluck, G., *Plating and Surface Finishing*, pp. 865–869 (Sep. 1975).

"Boric Acid in Nickel Solutions", by DuRose, A. H., *Plating and Surface Finishing*, pp. 52–55 (Aug. 1977).

"Nickel and Chromium Plating", by Dennis, J. K. et al., Butterworth & Co. (Publishers) Ltd. (1986). No month available.

"Decorative/Protection Coatings, Copper, Nickel, Chromium", by Lowenheim, F. A., *Electroplating*, pp. 210–219. No date.

"Nickel Sulfamate Plating, Its Mystique and Practicality", by Baudrand, D., *Metal Finishing*, pp. 15–18 (Jul. 1996).

Lowenheim, "Decorative/protection Coatings, Copper, Nickel, Chromium", Electroplating, pp. 210–219. No date.

*Primary Examiner*—Kathryn L. Gorgos
*Assistant Examiner*—Edna Wong
*Attorney, Agent, or Firm*—Scott J. Rittman

[57] ABSTRACT

This invention is predicated on the discovery by the present applicants that boric acid in conventional nickel plating baths is responsible for excessive lateral growth in the electroplating of nickel on nickel ferrite substrates. While nickel baths without boric acid do not yield acceptable electrodeposits, the boric acid interacts with the ferrite substrate to cause excessive lateral growth. Applicants further discovered that by eliminating the boric acid and adding another acidic plating buffer such as citric acid, one can obtain isotropic nickel plating and produce a wire-bondable surface.

8 Claims, 1 Drawing Sheet

ELECTROPLATING OF NICKEL ON NICKEL FERRITE DEVICES

CROSS REFERENCE TO RELATED APPLICATION

This application is a continuation-in-part of application Ser. No. 08/581,079, filed Dec. 29, 1995, which is herein incorporated by reference.

FIELD OF THE INVENTION

This invention relates to electroplating and, in particular, to electroplating a nickel layer on a nickel ferrite device.

BACKGROUND OF THE INVENTION

In the manufacture of circuits containing magnetic components, it is sometimes necessary to electroplate a nickel layer on conductors disposed on a nickel ferrite substrate. For example, in the fabrication of integrated power modules it is desirable to electroplate nickel onto copper conductors disposed on nickel zinc ferrite substrates. The nickel-plated conductors provide a surface that is wire-bondable with aluminum wire so that additional components can be directly connected to circuit components on the ferrite substrate.

While the technology of nickel plating is generally well established, excessive lateral growth is encountered in the conventional plating of nickel on nickel ferrite substrates. For example, in coating about 2 μm of nickel on ferrite-supported copper conductors, over 100 μm of lateral nickel growth was observed. Such lateral growth is highly deleterious in the fabrication of circuit devices because adjacent conductors can be shorted. Moreover such lateral growth precludes the fabrication of high density circuits having tightly-spaced conductor lines. Accordingly there is a need for a new method of electroplating nickel on nickel ferrite substrates.

SUMMARY OF THE INVENTION

This invention is predicated on the discovery by the present applicants that boric acid in conventional nickel plating baths is responsible for excessive lateral growth in the electroplating of nickel on nickel ferrite substrates. While nickel baths without boric acid do not yield acceptable electrodeposits, the boric acid interacts with the ferrite substrate to cause excessive lateral growth. Applicants further discovered that by eliminating the boric acid and adding another acidic plating buffer such as citric acid, one can obtain isotropic nickel plating and produce a wire-bondable surface.

BRIEF DESCRIPTION OF THE DRAWINGS

The advantages, nature and various additional features of the invention will appear more fully upon consideration of the illustrative embodiment described in connection with the accompanying drawings. In the drawings.

It is to be understood that these drawings are for purposes of illustrating the concepts of the invention and are not to scale.

DETAILED DESCRIPTION

Figure 1:
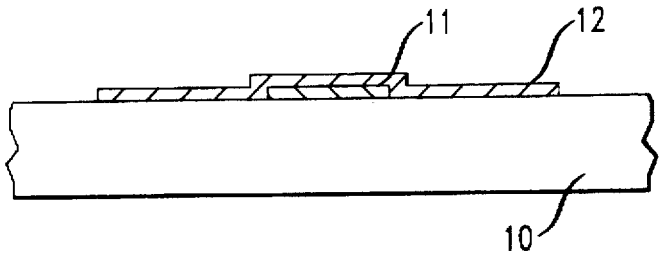
FIG. 1 (PRIOR ART)
FIG. 1 is a schematic cross section of a plated nickel ferrite substrate subject to excessive lateral growth.

Referring to the drawings, FIG. 1 is a schematic cross section of a nickel ferrite substrate 10, such as nickel zinc ferrite, bearing a conductor 11, such as copper. A coating of nickel 12 has been coated on the conductor using a conventional nickel plating bath. As illustrated, the plated nickel on either side of the conductor 11 extends substantially farther than the thickness of the nickel on top of the conductor. This lateral extension illustrates excessive lateral growth, and one can readily see that such growth limits the close spacing of conductors.

As specific examples, applicants observed plating patterns similar to FIG. 1 using a conventional Barrett nickel sulfamate bath. Two μm of nickel were plated on two parallel copper conductor lines spaced about 360 μm apart on a nickel zinc ferrite substrate. Plating was at a current density of 20 $mA/cm^2$ for 5 minutes. About 150 μm of nickel deposited on each side of the conductor, giving a vertical-to-lateral ratio of about 0.013. Reducing the plating time by increasing the plating current density did not eliminate the excessive lateral growth. Nor did plating with a different commercial bath, Sulfamtronics.

To investigate whether the boric acid contributed to the lateral growth, samples were plated with nickel using nickel sulfamate baths containing various amounts of boric acid ranging from 30 g/L to below 2 g/L. It was found that at a boric acid concentration of 2 g/L or lower, lateral growth was not observed. However, the resulting nickel coating was not wire-bondable to aluminum.

Since common nickel plating baths use boric acid as a buffering agent to prevent the formation of $Ni(OH)_2$ at the cathode interface and to prevent the formation of hydrogen, applicants formulated new buffered plating baths substantially free of boric acid (less than 2 g/L).

Figure 2:
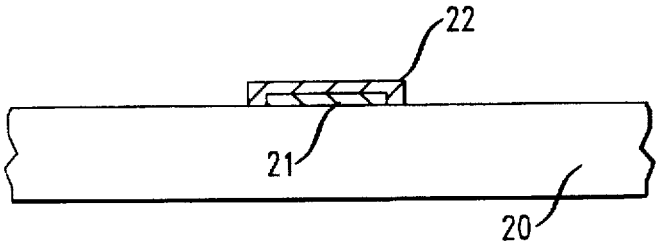
FIG. 2 is a schematic cross section of a nickel ferrite substrate plated in accordance with a preferred embodiment of the invention.

FIG. 2 is a schematic cross section of a nickel ferrite substrate 20 bearing a metal conductor 21 electroplated with nickel 22 from a buffered nickel plating bath free of boric acid. As illustrated, the lateral growth of nickel is substantially the same as the vertical growth, so the plating is isotropic.

The nickel ferrite substrate 20 can comprise any nickel-containing ferrite, but is preferably a ferrite of the form $Ni_{1-x}Zn_xFe_2O_4$, $NiFe_{2-x}Al_xO_4$ and $Ni_{1-x}Cd_xFe_xO_4$ where x can vary, from zero to nearly 1. The metal conductor 21 can be any metal which can be adhered to the nickel-ferrite substrate as by cofiring (silver-palladium) or by electroplating to a co-fired metal (e.g., copper electroplated to silver-palladium alloy). The nickel plating bath comprises a solution of nickel salt in an acidic buffer having a pH of about 3 or less which contains less than 2 g/L of boric acid. It is possible to use any acidic buffer that provides a pH in this range. Preferred nickel salts include nickel sulfaile, nickel sulfamate, nickel chloride and nickel fluoroborate. Preferred acidic buffers include citric acid, acetic acid, phosphoric acid, succinic acid, glycolic acid, and tartaric acid.

EXAMPLE 1

A nickel plating bath was made of the following composition:

| Compound | Amount (g/L) |
|---|---|
| $Ni(SO_3NH_2)_2.4H_2O$ | 383 |
| $NiCl_2.6H_2O$ | 11 |
| Citric Acid | 10 |

Nickel ferrite samples with copper conductors were plated at 20 $A/ft^2$ with a pH of about 1.9 and a temperature in the range 35°–45° C. No lateral growth was observed. The sample was plated to a thickness of 20 μm. Lateral growth was measured to be about 20 μm, which means that plating was isotropic. The appearance was acceptable, and the coating was wire-bondable to aluminum wire.

EXAMPLES 2–8

Nickel plating baths having the same type and concentration of nickel salts as Example 1, but with the buffers indicated below, were prepared. Nickel ferrite samples with copper conductors (pre-plated for 15 minutes at 25 A/ft$^2$) were also prepared and plated with nickel in the baths at 35° C. Table I below indicates the concentration of buffer, the plating current, the pH of the bath, whether the nickel exhibited excessive lateral growth (i.e., anisotropic growth), and whether the nickel coating was wire-bondable to aluminum.

TABLE I

| Buffer | Buffer Concen. | Plating Current | Bath pH | Excessive Lateral Growth | Wire-Bondable |
|---|---|---|---|---|---|
| Boric acid | 10 g/L | 15 A/ft$^2$ | 3.9 | Yes | Yes |
| Succinic acid | 10 g/L | 15 A/ft$^2$ | 2.22 | No | Yes |
| Glycolic acid | 10 g/L | 18 A/ft$^2$ | 1.68 | No | Yes |
| Tartaric acid | 10 g/L | 18 A/ft$^2$ | 1.71 | No | Yes |
| Formic acid | 10 g/L | 12 A/ft$^2$ | 4.88 | Yes | not attempted |
| Acetic acid | 10 g/L | 15 A/ft$^2$ | 1.72 | No | Yes |
| Phosphoric acid | 5 g/L | 7 A/ft$^2$ | 2.36 | No | Yes |

It is to be understood that the above-described embodiments are illustrative of only a few of the many possible specific embodiments which can represent applications of the principles of the invention. Numerous and varied other compositions can be made by those skilled in the art without departing from the spirit and scope of the invention.

The invention claimed is:

1. A method of electroplating nickel on a nickel ferrite device comprising the steps of:

providing a substrate of nickel-containing ferrite;

adhering a metal conductor to said substrate;

disposing said substrate and said conductor in a nickel plating bath comprising nickel salt and an acidic buffer substantially free of boric acid for buffering said bath to a pH of about 3 or less; and applying an electric current through said conductor to isotropically electroplate a desired thickness of nickel on said conductor.

2. The method of claim 1 wherein said nickel-containing ferrite comprises a ferrite selected from the group consisting of $Ni_{1-x}Zn_xFe_2O_4$, $NiFe_{2-x}Al_xO_4$ and $Ni_{1-x}Cd_xFe_2O_4$, where $0<X<1$.

3. The method of claim 1 wherein said metal comprises copper.

4. The method of claim 1 wherein said metal comprises silver palladium alloy.

5. The method of claim 1 wherein said nickel salt comprises a nickel salt selected from the group consisting of nickel sulfate, nickel sulfamate, nickel chloride and nickel fluoroborate.

6. The method of claim 1 wherein said acidic buffer comprises a buffer selected from the group consisting of citric acid, acetic acid, phosphoric acid, succinic acid, glycolic acid, and tartaric acid.

7. A method of electroplating nickel on a nickel ferrite device, comprising the steps of:

providing a substrate of nickel-containing ferrite;

adhering a metal conductor to said substrate;

disposing said substrate and said conductor in a nickel plating bath comprising nickel sulfamate and an acidic buffer substantially free of boric acid for buffering said bath to a pH of about 3 or less; and applying an electric current through said conductor to isotropically electroplate nickel onto said conductor.

8. The method of claim 7, wherein said acidic buffer comprises a buffer selected from the group consisting of citric acid, acetic acid, phosphoric acid, succinic acid, glycolic acid, and tartaric acid.

* * * * *